United States Patent [19]

Taplin

[11] Patent Number: 4,516,604

[45] Date of Patent: May 14, 1985

[54] PILOT OPERATED SUPPLY AND WASTE CONTROL VALVE

[76] Inventor: John F. Taplin, 15 Sewall St., West Newton, Mass. 02165

[21] Appl. No.: 602,438

[22] Filed: Apr. 20, 1984

[51] Int. Cl.[3] ..... F15B 13/043

[52] U.S. Cl. ..... 137/596.15; 91/454; 137/596.16; 251/24; 251/61.1

[58] Field of Search ..... 91/454, 461, 467; 137/106, 596.14, 596.15, 596.16, 596.17, 625.2, 625.44, 625.65, 870; 251/24, 61.1

[56] References Cited

U.S. PATENT DOCUMENTS

| | | | |
|---|---|---|---|
| Re. 29,481 | 11/1977 | Larner | 137/596.15 |
| 675,946 | 6/1901 | Gulland | 251/24 |
| 901,584 | 10/1908 | Bowman | 251/24 |
| 1,231,280 | 6/1917 | Metten | 251/24 X |
| 2,417,994 | 3/1947 | Sheets | 251/24 |
| 2,677,390 | 5/1954 | Davis et al. | 251/61.1 X |
| 2,877,791 | 3/1959 | Rich | 251/61.1 X |
| 2,911,005 | 11/1959 | Adelson . | |
| 2,970,611 | 2/1961 | Hoge . | |
| 2,984,218 | 5/1961 | Christianson . | |
| 2,984,257 | 5/1961 | McCormick et al. . | |
| 3,016,918 | 1/1962 | Wentworth . | |
| 3,080,887 | 3/1963 | Brandenberg . | |
| 3,265,089 | 8/1966 | Nill | 137/596.16 |
| 3,389,720 | 6/1968 | Brandenberg | 137/625.66 |
| 4,072,169 | 2/1978 | Heiser et al. | 137/625.64 X |
| 4,074,701 | 2/1978 | Kemmler | 251/61.1 X |
| 4,076,046 | 2/1978 | Hieronymus et al. | 137/596.17 X |
| 4,111,226 | 9/1978 | Cameron | 137/269 |
| 4,169,490 | 10/1979 | Taplin | 137/596.18 |
| 4,244,392 | 1/1981 | Griswold et al. | 137/107 |
| 4,276,897 | 7/1981 | Griswold | 137/107 |
| 4,385,639 | 5/1983 | Holborow | 137/106 |
| 4,454,893 | 6/1984 | Orchard | 251/61.1 X |

*Primary Examiner*—Gerald A. Michalsky

*Attorney, Agent, or Firm*—Hamilton, Brook, Smith & Reynolds

[57] ABSTRACT

Supply and waste diaphragm valves communicate with each of two load ports 26, 28 and all valves are controlled by a pilot valve 78 and a pressure reversing valve 74. In one form, the pilot valve 356 has a rocker arm valve member 366. The pilot valve 78 applies high or low fluid pressure to control chambers 48, 64 and the control faces of two main diaphragms 40, 46, and it applies the same pressure to a diaphragm 90 which actuates the reversing valve 74. The pressure reversing valve 74 applies a reverse pressure to the control chambers 56, 62 and the control faces of the other two main diaphragms 42, 44. The pressure reversing valve 74 is a pressure actuated, supply and waste type valve in which the pressure applied by the pilot valve actuates a pressure driven element. The pressure driven element may be a diaphragm 90 or bellows 100. A higher control pressure is obtained with a ram nozzle 66 directed into the supply fluid at a point of maximum flow velocity. Seat loading of the diaphragms may be created by positioning valve seats 260, 266 beyond the free positions of the diaphragms 252, 270.

15 Claims, 10 Drawing Figures

PILOT OPERATED SUPPLY AND WASTE CONTROL VALVE

CROSS REFERENCE TO RELATED APPLICATION

Supply Control Valve with Integral Pressure Limiter, Ser. No. 602,420, filed Apr. 20, 1984.

TECHNICAL FIELD

The present invention relates to fluid control valves and in particular to three-way and four-way valves wherein the main valving elements are diaphragms.

BACKGROUND

Control valves are widely used to apply high pressure fluid, hydraulic or pneumatic, to one or more conduits connected to remote or local loads, and thereafter exhaust that fluid from the load. In three-way valves, the fluid is alternately supplied to and exhausted from a single load conduit; in four-way valves, the fluid is supplied to one load line as it is exhausted from another load conduit, and thereafter the fluid is exhausted from the first conduit and supplied to the second conduit. Such valves have many uses, but a primary use is as a directional control valve which supplies and exhausts fluid to and from each end of a cylinder to drive a piston. As high pressure fluid is applied to one end of the cylinder, it is exhausted from the other to drive the piston in a first direction. Thereafter, the high pressure fluid is supplied to the second end of the cylinder and exhausted from the first to drive the piston in the opposite direction.

Large three and four-way control valves are themselves generally controlled by one or more pilot valves. The pilot valves may be actuated manually, by a fluid, by a solenoid, or by any other drive mechanism.

One form of pilot operated four-way valve is shown in my prior U.S. Pat. No. 4,169,490. The valve shown in that patent includes four poppet valves which are driven pneumatically through respective diaphragms. The control pressures applied to the diaphragms can be obtained from a relatively simple pilot valve because a single pressure can be applied to each of the four diaphragms. The reverse operation of the valves required to close waste valves while supply valves are open and vice versa can be obtained by the mechanical arrangement of the poppet valves themselves. A disadvantage of poppet valves is that the poppets add to the expense of the system. Further, their large mass, relative to diaphragm valves, results in harder pounding of the poppet valves and thus increased wear. Therefore, in many applications a more simple and smaller mass diaphragm valve may be preferred despite the more complicated controls required for such systems.

One form of four-way valve in which the main valve members are diaphragms is shown in U.S. Pat. No. 2,911,005 to Adelson. In that system, a pilot valve alternately applies high and low control pressures to the back, control faces of one pair of diaphragms. A second valve responds to that control pressure to supply a reversed, low or high, pressure to the control faces of another pair of diaphragms. A significant disadvantage of the Adelson system is that it requires two different externally supplied levels of pressure, both of which are above the pressure level of the supply fluid to the main valve.

Another form of four-way valve wherein the main valving elements are diaphragms is shown in U.S. Pat. No. 3,016,918 to Wentworth. The Wentworth valve utilizes the pressure of the supply fluid to derive the control pressures to be applied behind the diaphragm valves. A disadvantage of the Wentworth and similar systems is that they require several flow restrictions in the control lines. Where the supply fluid contains foreign materials such as sand, grit, gums or varnish, which is the general case in industrial applications, those restrictions are subject to clogging. If filter elements are used to clean the supply fluid applied to the control network, those filters must be replaced or cleaned periodically.

Yet another form of pilot operated four-way valve wherein diaphragms are used as the main valving elements is shown in U.S. Pat. No. 2,984,257 to McCormick et al. In that system the control pressures are also derived from the supply fluid. Restrictions in the control network are avoided by the use of two separate but similar pilot valves. The pilot valves have to be operated by two separate, independent solenoids or by two other separate and distinct externally applied forces. The requirement for two actuators adds to the cost of the system, to the complexity of the system and to maintenance requirements. It is therefore advantageous, even where the system is solenoid actuated, to use only one solenoid or other actuator to actuate a single pilot valve.

Yet another form of piloted four-way control valve utilizing diaphragms as the main valve elements is shown in U.S. Pat. No. 4,385,639 to Holborow and U.S. Pat. No. Re. 29,481 to Larner. In those systems, the control pressures are obtained from pilot spool valves. The high control pressures are derived from the supply fluid. Sliding parts of spool valves require clean fluid because they are prone to "spool sticking" or "slide sticking" due to the effects of contaminants such as varnish and fine particulate matter. If filters are used, they must be replaced or cleaned periodically.

DISCLOSURE OF THE INVENTION

In accordance with principles of the present invention, supply and waste control valves are provided which allow for a single primary pilot operating mechanism such as a single solenoid, which require no restrictions which are prone to clogging and which require no sliding parts which are prone to binding. All of the main valves are diaphragm valves which are controlled by a higher pressure taken from the fluid supply pressure and a lower pressure; the pressures are alternately applied to the control faces of the diaphragms. A pilot valve and a pressure reversing valve control the fluid pressures applied to the control faces of the diaphragms to open and close a supply diaphragm valve communicating with each load port while conversely closing and opening a waste diaphragm valve communicating with the load port.

The control means may include a pilot valve for applying higher fluid pressure or lower fluid pressure to the control face of one diaphragm valve or a set of diaphragm valves. A pressure reversing valve applies a reverse, lower or higher pressure to the control faces of other diaphragm valves. The pressure reversing valve includes a supply and waste valve in which higher or lower pressure is applied to one surface of a pressure driven element and a lower pressure is applied to the opposite surface of the pressure driven element.

In one case, the pressure driven element is a diaphragm which is formed on a single sheet of gasket material along with the main diaphragm valves. The diaphragm associated with the reversing valve drives a valve member against either a first seat supplying higher pressure or a second seat providing lower pressure to a reversed-pressure chamber. In another embodiment, the pressure driven element of the reversing pilot valve is a bellows which drives a pivotal arm into contact with the seats which supply higher pressure and lower pressure.

In a preferred three-way supply and waste pilot valve, the valve member is a rocker arm which extends into a pilot control pressure chamber through a seal. The rocker arm may be solenoid actuated.

In each valve arrangement, a pressure which is somewhat higher than the supply fluid is obtained by a ram nozzle directed into the supply fluid. In the control network only higher and lower pressure levels are used, and the higher control pressure is derived from the supply fluid pressure.

As an alternative to the higher pressure supplied by the ram nozzle or in combination with that higher pressure, each diaphragm which faces the supply fluid can be mechanically preloaded against the pressure of the supply fluid by a valve seat positioned beyond the free position of the diaphragm. That preloading may be provided by a molded diaphragm or by a valve seat raised beyond the normal resting plane of a flat diaphragm.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF PREFERRED EMBODIMENTS

Figure 1:
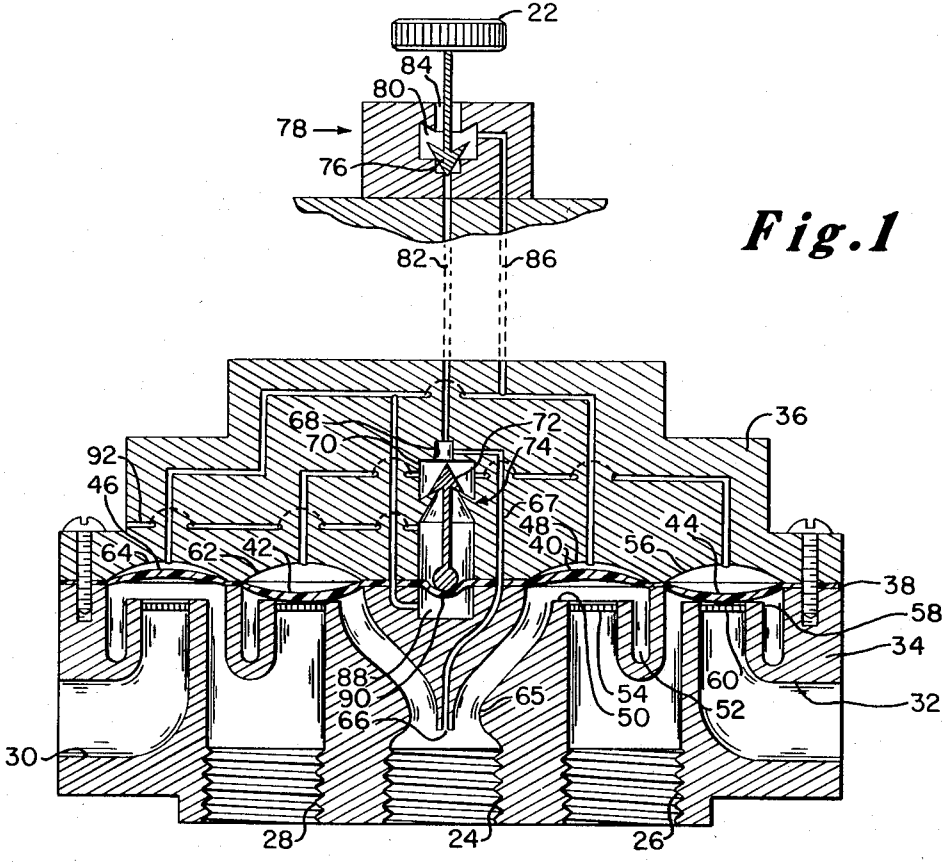
FIG. 1 is a cross sectional view of a principle embodiment of the invention showing a four-way valve which includes a hand operated pilot valve and a fluid actuated reversing valve.
Figure 2:
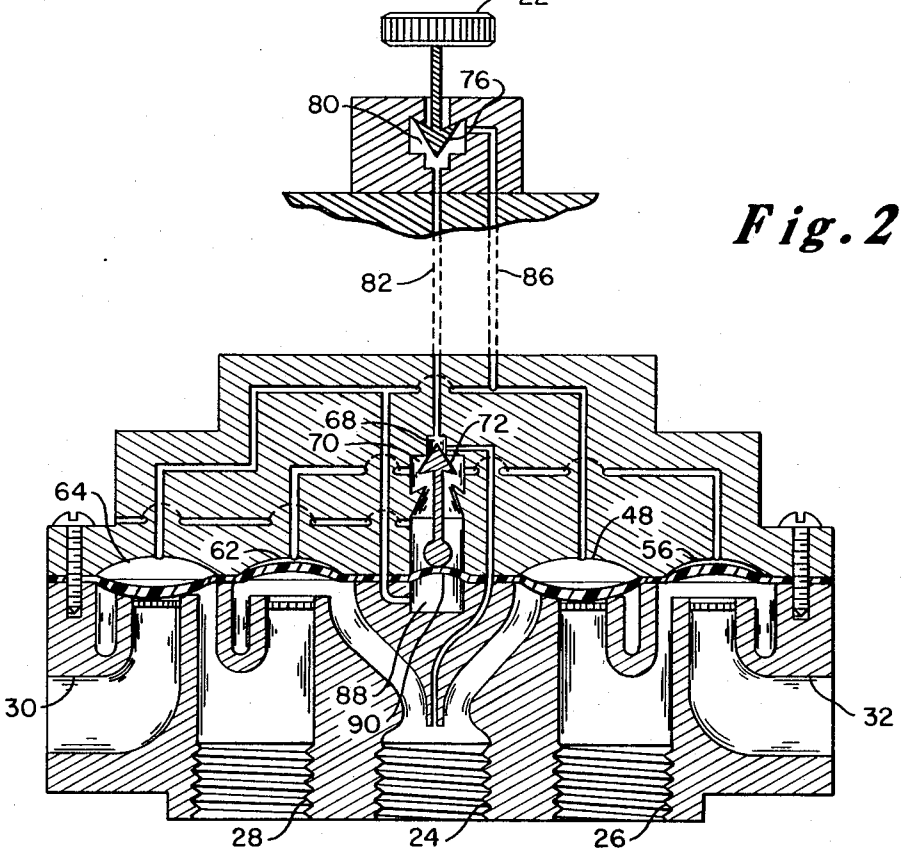
FIG. 2 shows the valve of FIG. 1 but with the control pressures applied to the diaphragms reversed.

A pilot operated four-way supply and waste control valve embodying this invention is shown in FIGS. 1 and 2. The two figures show the two responses of the valve to the control knob 22. When the knob is pushed down as shown in FIG. 1, supply fluid, which may be hydraulic or pneumatic, is directed from a supply port 24 to a load port 26. From the port 26, the supply fluid may be applied, for example, to one end of a piston cylinder. At the same time, waste fluid is vented from a load port 28 to a waste port 30. The port 28 may, for example, be connected to the opposite end of a piston cylinder.

When the knob 22 is lifted as shown in FIG. 2, the valving of the supply and waste ports to the two load ports 26 and 28 is reversed. Specifically, the supply fluid is applied to the port 28, and port 26 is vented through a waste port 32. Waste ports 30 and 32 may be connected so that the valve operates as a four port control valve with one supply port, one waste port and two load ports.

As an alternative, ports 30 and 32 could be utilized as supply ports and the center port 24 could be utilized as an exhaust port. Also, the supply port 24 could communicate with the conduit centered within the valve seat 50, for example, and the load port 26 could communicate with an annulus 52.

The main valve assembly comprises a lower main fluid handling block 34 and an upper control block 36. Crossings of control pressure conduits are indicated by broken lines.

The blocks 34 and 36 are separated by a flexible gasket 38. Four main diaphragms are formed in that gasket. They include two supply diaphragms 40 and 42 and two waste diaphragms 44 and 46. The positions of those diaphragms are controlled by higher and lower pressures applied to their upper control surfaces through conduits in the control block 36. For example, as shown in FIG. 1, a lower pressure is applied to the control chamber 48 on the top of diaphragm 40 and the diaphragm is pushed away from its annular valve seat 50 by the higher supply pressure applied to the annulus 52 from the supply port 24. The supply fluid is therefore free to flow through a support grid 54 into the load port 26 and to the load connected to that port. Higher pressure is applied to the control chamber 56 on top of diaphragm 44 associated with the load port 26. That higher control pressure presses the diaphragm 44 against its annular valve seat 58 to close the passage from the port 26 to the waste port 32. The diaphragm rests against the support grid 60 to minimize stress on the diaphragm due to the pressure differential between the pressure in the control volume 56 and the lower pressure in the waste port 32.

It can be seen that the supply and waste valves associated with load port 28 are operated conversely to those associated with port 26. Thus, higher pressure is applied to the control chamber 62 to close that supply diaphragm valve, and lower pressure is applied to the control chamber 64 on top of diaphragm 46 to open that waste valve. As can be seen in FIG. 2, when the knob 22 is lifted, the control pressures are reversed such that the supply diaphragm valve to port 26 is closed while the waste diaphragm valve from port 26 is open, and the supply diaphragm valve to port 28 is open while the waste diaphragm valve from that port is closed.

The derivation of the control pressures will now be described. It should first be noted that the valve shown in FIGS. 1 and 2 is self-powered in that each control pressure is either ambient pressure or a higher pressure obtained from the supply fluid applied to port 24. To that end, a ram nozzle 66 is directed into a point in the supply fluid. The resultant pressure in control conduit 67 is slightly higher than that at the supply port 24 by a ram pressure $\Delta P$. The ram pressure $\Delta P$ can be defined by the following function:

$$\Delta P = \tfrac{1}{2}(Q/A_T)^2(\rho/g) \quad (1)$$

where Q is the supply fluid flow at an absolute pressure Pa, $A_T$ is the total flow area of supply fluid past the end of the ram nozzle, $\rho$ is the fluid density at Pa and g is acceleration due to gravity. The pressure $Pa+\Delta P$ obtained in the ram nozzle 66 is the higher control pressure applied throughout the control network including the control chambers behind the diaphragm valves.

In some instances the mechanical load of the diaphragm against the supply seat is sufficient to insure adequate seat closure. In such cases it is not necessary to employ a ram nozzle so that the higher control pressure in conduit 67 is not augmented.

Figure 3:
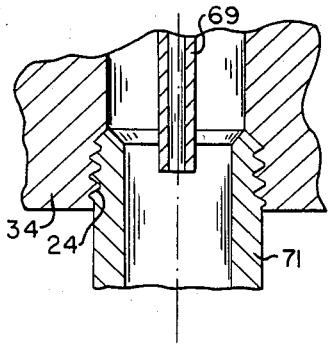
FIG. 3 shows an alternative ram nozzle arrangement for use in the embodiments of FIGS. 1 and 2.

An alternative ram arrangement is shown in FIG. 3. With this arrangement, a tubular ram nozzle extends into the end of a conduit 71 threaded or otherwise attached to the block 34 at the supply port 24.

In a typical case, a system of FIGS. 1, 2 or 3 might provide a flow rate of 590 cubic inches per second through a flow area $A_T$ of 0.2 square inches where the absolute pressure of the supply fluid is 99.7 pounds per square inch (85 psi gauge). From equation 1, where the supply fluid is air:

$$\Delta P = 1/2\,(590/.2)^2\,(3.3 \times 10^{-4})/384$$
$$= 3.74 \text{ pounds per square inch}$$

Thus, the control pressure applied to the control faces of the diaphragms exceeds the pressure of the supply fluid by at least three pounds per square inch to assure firm seating of the diaphragms against the valve seats.

The higher control pressure from the ram nozzle is applied to a higher pressure port 68 above a reversed-pressure chamber 70. From the port 68, the higher pressure acts downward against a valve member 72 of a pressure reversing valve shown generally at 74.

When the knob 22 is pressed down as shown in FIG. 1, it forces a valve member 76 against its valve seat in pilot valve 78. Chamber 80 is thereby closed to a higher pressure line 82 leading from the port 68. The chamber 80 is open to lower, atmospheric pressure through a port 84. The pressure in pilot valve chamber 80, which in this case is low, is applied through a control conduit 86 to the control chambers 64 and 48 associated with the supply and waste valves of the respective load ports 26 and 28. Thus those valves are opened together.

The same lower pressure is also applied to a control pressure chamber 88 in the reversing valve 74. The chamber 88 is closed by a diaphragm 90 which is formed in the gasket 38. The opposite face of the diaphragm 90 is always exposed to low ambient pressure through a port 92. As previously noted, higher pressure is always applied to the upper surface of the valve member 72 of the reversing valve, and that higher pressure drives the valve member downward against the diaphragm 90 and the low pressure in the control pressure chamber 88. The valve member 72 thus rests against its lower valve seat to close the reversed pressure chamber 70 from the ambient pressure above the diaphragm and to open that chamber to a higher pressure in port 68.

The pressure in the reversed pressure chamber 70, which in this case is now higher, is applied to the control chambers 56 and 62. The higher pressure closes the waste and supply valves of the respective load ports 26 and 28.

Operation of the valve with the knob 22 pulled up will now be described with reference to FIG. 2. With the knob up, the valve member 76 is pushed up against its upper valve seat by the higher pressure in conduit 82. The chamber 80 is thereby closed to ambient pressure and open to the higher pressure of conduit 82. That higher pressure is now applied through conduit 86 to the control chambers 48 and 64 to close the supply and waste diaphragm valves to the respective ports 26 and 28.

The higher pressure on conduit 86 is also applied to the control pressure chamber 88 of the pressure reversing valve. The valve member 72 is now subjected to higher pressure forces from both above and below the valve member. However, the cross sectional area of the control diaphragm 90 is greater than the projected seating area of the valve member 72, so the valve member is forced upward by the diaphragm 90. The valve member rests against an upper valve seat to close the reversed-pressure chamber 70 from the higher pressure port 68 and to open the chamber to the ambient pressure above the diaphragm 90. Thus, low ambient pressure is now applied from the reversed-pressure chamber 70 to the control chambers 56 and 62, and the waste and supply diaphragm valves of the respective load ports 26 and 28 are opened.

It can be seen that supply diaphragm 40 and waste diaphragm 46 respond together to the pressure in conduit 86 which is determined by the first pilot valve 78. The waste diaphragm 44 and the supply diaphragm 42 are operated together in an opposite manner in reponse to a reverse pressure obtained from the pressure reversing valve 74.

Several notable features of the valve of FIGS. 1 and 2 contribute to the reliable, self-powered nature of the piloted control. A control pressure higher than the supply pressure is obtained by the ram nozzle. All control conduits have substantial bores; no restrictions in these conduits are required. The system has no sliding parts. Further, only two pressure levels are required in the control: the higher pressure and lower, generally atmospheric pressure. No additional pressure levels which would complicate the system are required to operate the pressure reversing valve 74.

The need for only two control pressure levels is accomplished by utilizing, as the reversing valve 74, a pressure actuated, supply and waste type valve in which the pressure in the chamber 88 opposes a low pressure on the opposite face of the primary pressure driven element, the diaphragm 90. The high pressure applied to the port 68 opposes the pressure in the control pressure chamber 88 through the valve member 72, a secondary pressure driven element. With this arrangement, when the pressure in chamber 88 is low, the valve member sees only low pressures opposing the high pressure of port 68, and the valve member is moved down. On the other hand, when the pressure in chamber 88 is high, the valve member sees opposing high pressures, but the larger cross sectional area of the diaphragm 90 moves the valve member upward.

Figure 4:
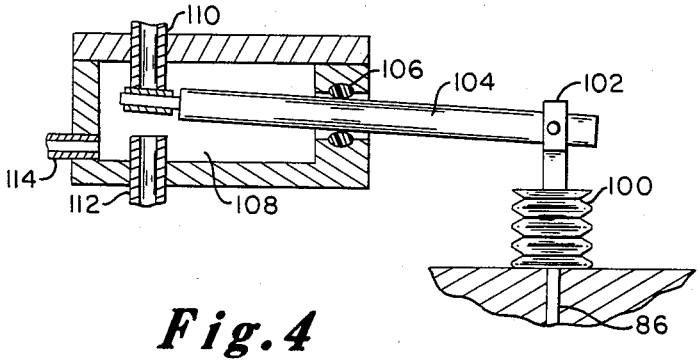
FIG. 4 is a side view, partially in section, of an alternative reversing valve for use in the four-way valve of FIGS. 1 and 2.

Another pressure reversing valve which operates on similar principles is shown in FIG. 4. The reversing valve 74 can be replaced by the valve shown in FIG. 4. In this valve, the higher or lower pressure of conduit 86 is applied to the interior of a bellows 100. A post 102 is driven by the bellows 100 to drive a rocker arm 104. The rocker arm pivots at a seal 106. The opposite end of the rocker arm extends into a reversed-pressure chamber 108. The pressure in chamber 108 is that of a low pressure port 110 or a higher pressure port 112. The pressure in the chamber 108 is conducted through a control conduit 114 to the control chambers 56 and 62 of FIG. 1.

When the pressure in line 86 is low the post 102 drops as shown in FIG. 4, and the low pressure port 110 is closed by the rocker arm. Higher pressure is therefore applied from port 112 to the chamber 108 and to the control conduit 114. On the other hand when higher pressure is applied to the bellows 100, the rocker arm is pivoted to close the higher pressure port 112; conduit 114 is thus vented through the chamber 108 and low pressure port 110.

In the arrangement of FIG. 4, the primary pressure driven element is the bellows and the outside of the bellows is exposed to ambient pressure. The pressure within the bellows, against the bellows pressure area, is sufficient to overcome the opposing higher pressure applied from port 112 against the valving end of the rocker arm 104.

It is advantageous to have the four main diaphragms and the control diaphragm on a common plane. This allows for forming the valve chambers in two complementary blocks. It also allows for the diaphragms to be formed on a single sheet of flexible material which also serves as a gasket. In the embodiment of FIG. 1, the diaphragm valves are arranged in line on a common plane. An alternative single plane arrangement is shown in FIG. 5.

Figure 5:
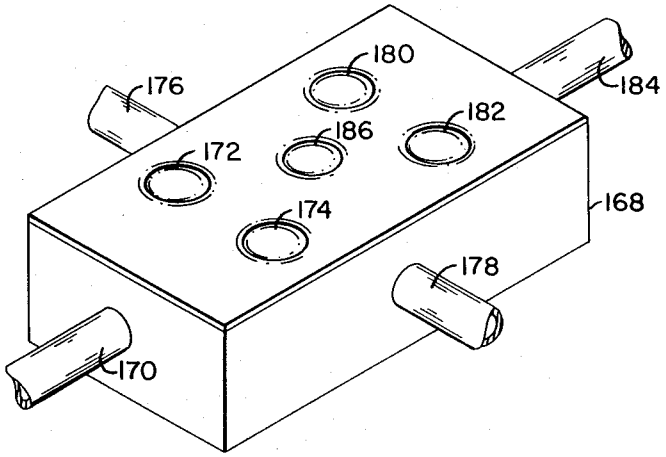
FIG. 5 is a perspective plan view of a four-way valve illustrating an alternative arrangement of the diaphragms in a system including a control diaphragm and four main diaphragms.

FIG. 5 shows an arrangement of diaphragms on a main porting block 168. The control porting block is omitted. In this configuration, the supply and waste valves are positioned at the four corners of a square. Supply fluid from a supply port 170 is directed to the two supply valves having diaphragms 172 and 174, only one of which is open at any time. The supply fluid is applied through those supply valves to the respective load ports 176 and 178. Similarly, the loads 176 and 178 can be vented through waste valves having diaphragms 180 and 182 to a common waste port 184. A control diaphragm 186 for the pressure reversing valve is positioned at the center of the square or the rectangle.

Figure 6:
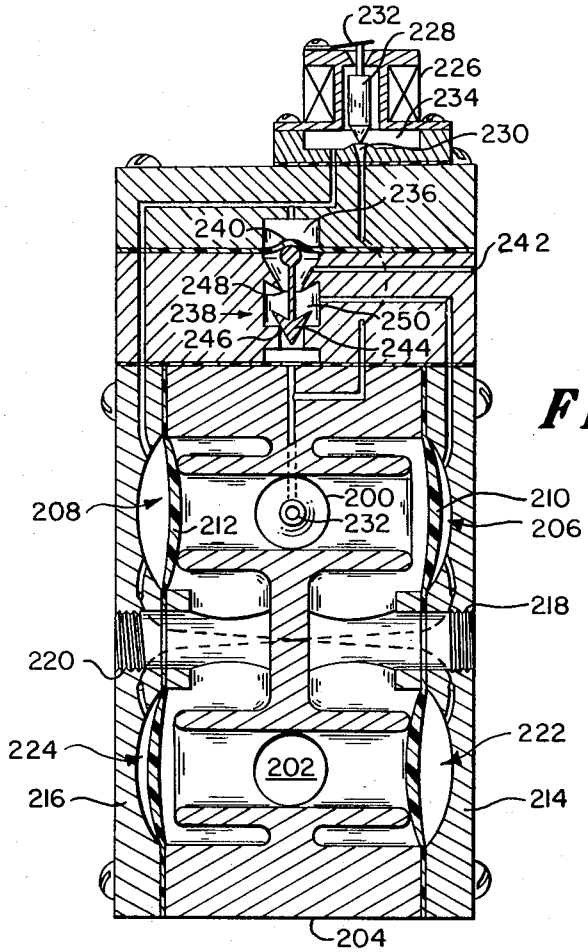
FIG. 6 is a cross sectional view of yet another embodiment of the invention in a four-way valve in which a pilot valve is solenoid actuated and a pressure reversing valve is pressure actuated.

The necessary outer dimensions for a valve do not always allow for a common plane arrangement of the valve diaphragms. An alternative arrangement is shown in FIG. 6. In this system, the supply and waste ports 200 and 202 extend perpendicular to the plane of the drawing of FIG. 6 into a center block 204. The supply fluid is directed both to the right and to the left, as viewed in FIG. 6, to respective supply diaphragm valves 206 and 208. The diaphragms 210 and 212 in those valves are formed in flexible gaskets between the center block 204 and respective side blocks 214 and 216. Supply fluid from the respective valves 206 and 208 is conducted to respective load ports 218 and 220 in the blocks 214 and 216.

Similarly, the load ports 218 and 220 are connected to waste diaphragm valves 222 and 224. From these valves, waste fluid is directed to the waste port 202.

The pilot valve and pressure reversing valve shown in FIG. 6 are similar to those of the embodiment of FIG. 1 except that the pilot valve is solenoid controlled. A solenoid coil 226 drives a valve member 228 to open a higher pressure port 230 supplied from a ram nozzle 232 or directly from the fluid supply pressure with no ram nozzle. The valve member acts against a leaf spring 232 which returns the valve member down to close port 230 when the solenoid is not actuated.

The higher or lower control pressure in the pilot valve chamber 234 is applied through control conduits to the control chambers of diaphragm valve 208 and waste valve 222. It is also applied to a control pressure chamber 236 of a pressure reversing valve 238. The chamber 236 is closed by a diaphragm 240 and the opposite face of the diaphragm is exposed to atmosphere through a conduit 242. The diaphragm 240 controls a valve member 244 to press that valve member against the higher pressure valve seat 246 or the opposing lower pressure valve seat 248 and thus determine the pressure in the reversed pressure chamber 250. The reversed pressure is applied to the control chamber of diaphragm valve 206 and the control chamber of diaphragm valve 224.

Figure 7:
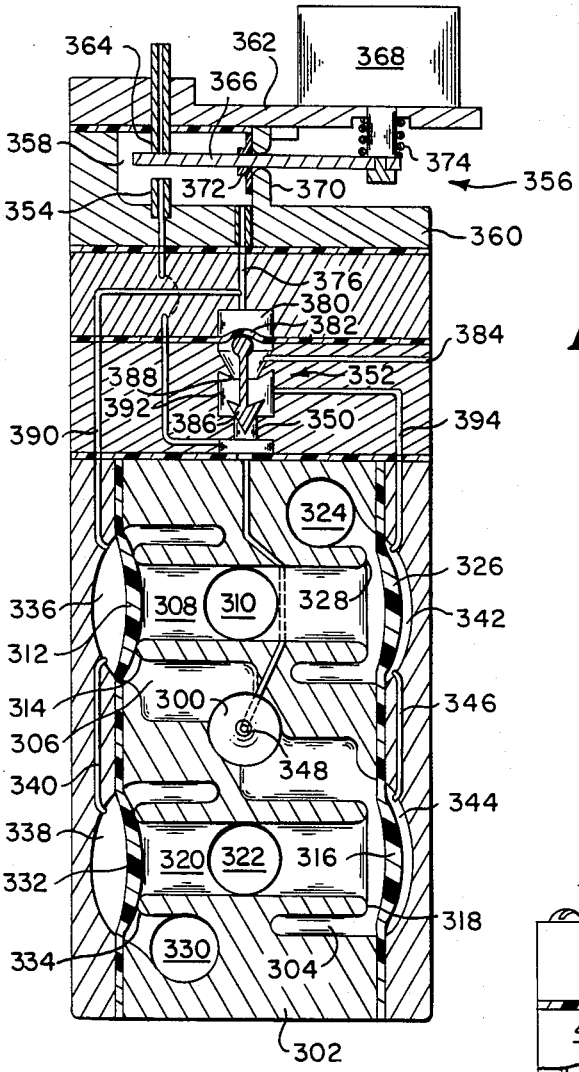
FIG. 7 is a cross sectional view of another solenoid actuated embodiment of the invention in a four-way valve.

A modification of the supply and waste control valve of FIG. 6 is shown in FIG. 7. This embodiment allows for a less complex arrangement of control conduits to the main diaphragm valves and also allows all outside conduits into the supply, exhaust, and load ports to be laid in parallel either from a single face of the valve assembly or from opposite faces. The embodiment of FIG. 7 also shows an improved solenoid actuated pilot valve.

All of the supply, waste, and load ports of the valve of FIG. 7 are directed perpendicular to the plane of the drawing and, in this case, all extend through the far side of the valve. A supply port 300 is provided at the center of the main valve block 302. It communicates with two annuluses 304 and 306. As shown, a supply conduit 308 from the annulus 306 to load port 310 is closed by a diaphragm 312 pressed against an annular valve seat 314. On the other hand, diaphragm 316 is positioned away from its valve seat 318 so that supply fluid flows from the annulus 304 through conduit 320 to a second load port 322. Conversely, the load port 310 is open to an exhaust port 324 past the open diaphragm 326 and its valve seat 328; and load port 322 is closed to a waste port 330 by a diaphragm 332 pressed against its valve seat 334.

In the arrangement of FIG. 7, the supply diaphragms 312 and 316 are positioned diagonally relative to each other; similarly, the waste valve diaphragms 326 and 332 are diagonally positioned. Accordingly, the supply diaphragm 312 and waste diaphragm 332, which are controlled by a common control pressure, are positioned on a common side of the main valve control block 302. Therefore, the two control chambers 336 and 338 can be joined by a simple straight conduit 340. Similarly, the oppositely controlled pair of diaphragms 326 and 316 are positioned on the other side of the main block 302, and their respective control chambers 342 and 344 are joined by a simple conduit 346. Unlike the embodiment of FIG. 6, it is not necessary for the control pressure conduits to connect diagonally positioned control chambers.

As in prior embodiments, a higher control pressure is obtained by means of a ram nozzle 348 centered in the supply port 300. Ram nozzle 348 communicates with a higher pressure port 350 to a pressure reversing valve 352 and with a higher pressure input 354 of a pilot valve 356.

The pilot valve 356 is substantially different from previously disclosed pilot valves. A pilot control pressure chamber 358 is formed in the block 360 and closed by a cap 362. A lower pressure port 364, open to atmosphere, is positioned opposite to the higher pressure port 354. One or the other of the higher and lower pressure ports 354 and 364 is closed by a rocker arm 366 which is actuated by a solenoid 368. The arm 366 is a flexible vane which extends through a slot in the side wall 370 of the pilot control pressure chamber 358. A collar seal 372 prevents leakage of higher pressure gas from the chamber 358.

A compression spring 374 closes the lower pressure port 364 when the solenoid 368 is not energized. When the solenoid is actuated, the vane 366 is pivoted on the wall 370 to close the higher pressure port 354. With the higher pressure port closed, the pressure applied from the chamber 358 to a control conduit 376 changes from a higher control pressure to a lower control pressure.

With the solenoid actuated pilot valve 356, a potential for binding of the solenoid is substantially reduced. In the embodiment of FIG. 6, the solenoid is exposed to the supply fluid through the higher pressure conduit 230. With the arrangement of FIG. 7, the solenoid is positioned at atmosphere and is isolated from the supply fluid. By the use of a rocker arm, the solenoid can be isolated from the control fluid without any sliding action at the seal or at the surfaces of valving ports 364 and 354 which would cause wear or result in binding due to varnish or particulate matter in the control fluid.

As in previous embodiments, the control pressure determined by the pilot valve is applied to a control pressure chamber 380 of a pressure reversing valve 352. The control pressure is applied to one face of a diaphragm 382, and the opposite face of the diaphragm is exposed to atmosphere through a conduit 384. With a higher pressure in conduit 376 and control pressure chamber 380, the diaphragm is pressed down, as viewed in FIG. 7, against the valve member 386. The valve member is thus pressed against the higher pressure port 350, thereby opening a lower pressure port 388. Thus, as higher pressure is applied from conduit 376 through conduit 390 to control chamber 336 and control chamber 338, lower pressure is applied from the reversed-pressure chamber 392 through a conduit 394 to the control chambers 342 and 344. The supply diaphragm 312 and waste diaphragm 332 are pressed against their respective valve seats, and the waste diaphragm 326 and supply diaphragm 316 are moved away from their valve seats.

On the other hand, when the solenoid 368 is actuated and the higher pressure port 354 is closed, lower, atmospheric pressure control fluid is applied to the control chambers 336 and 338 and to the control pressure chamber 380. The higher pressure in port 350 moves the valve member 386 upward to close the lower pressure port 388 in the pressure reversing valve and open the higher pressure port 350 to the reversed-pressure chamber 392. Thus, higher pressure is applied to the control chambers 342 and 344 to close the respective diaphragms 326 and 316 against their valve seats.

Figure 8:
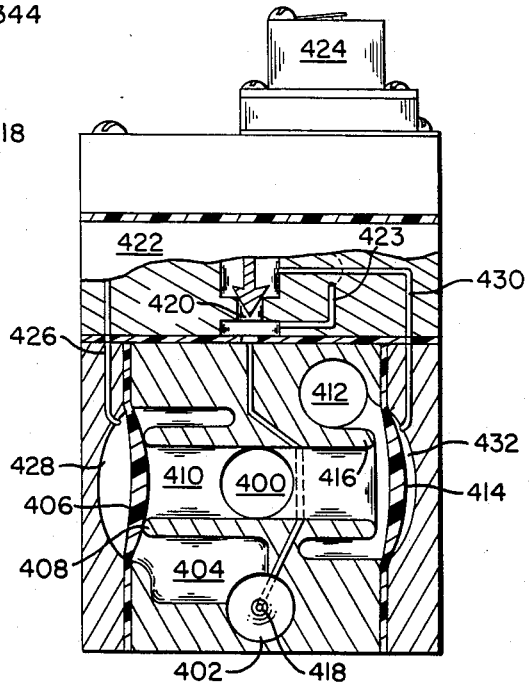
FIG. 8 is a cross sectional view of an embodiment of the invention in a three-way valve.

FIG. 8 shows a three-way supply and waste control valve embodying many of the principles previously discussed. With a three-way valve, only a single main supply valve and a single main waste valve are required to control the flow of fluid to and from a single load port 400. As shown in FIG. 8, the supply fluid from a supply port 402 fills an annulus 404. A diaphragm 406 is shown positioned against its annular valve seat 408 to close a conduit 410 between the annulus 404 and the load port 400. The conduit 410 is opened to a waste port 412 by a diaphragm 414 positioned away from its valve seat 416.

As in previous embodiments, higher and lower control pressures are simultaneously required to open one main valve communicating with the load port as the other valve communicating with the load port is closed. To that end, a higher control pressure is obtained by means of a ram nozzle 418. The ram nozzle communicates with a higher pressure port 420 of a pressure reversing valve 422 and, through conduit 423, with a higher pressure port in a solenoid actuated pilot valve 424. The reversing valve is identical to that shown in FIGS. 6 and 7 and is therefore not shown in detail in FIG. 8. The solenoid actuated pilot valve may be like either of the valves shown in FIGS. 6 and 7. The control pressure from the pilot valve 424 is applied through conduit 426 to a control chamber 428 and the control surface of the diaphragm 406. A reversed pressure is applied from the pressure reversing valve 422 through a conduit 430 to the control chamber 432 and the control surface of diaphragm 414. As before, when the solenoid of the pilot valve 424 is actuated, a lower pressure is applied to conduit 426 and the control chamber 428 and a higher pressure is applied to conduit 430 and the control chamber 432 to reverse the positions of the diaphragms 406 and 414.

In each of the above embodiments each main supply diaphragm valve would position itself to a closed position if a control pressure equal to the opposing supply fluid pressure were applied to the control chamber. In most situations a supply valve diaphragm would then be more securely seated by a lowering of the pressure in the center conduit below the diaphragm due to fluid exhaust action through the waste port. However, to assure proper seating of a diaphragm in all situations it is best that the closing force applied to the diaphragm be greater than the opposing pressure force of the supply fluid. In the previous embodiments, this higher closing force is obtained by a control pressure higher than the supply fluid pressure. The higher control pressure is obtained by a ram nozzle.

Figure 9:
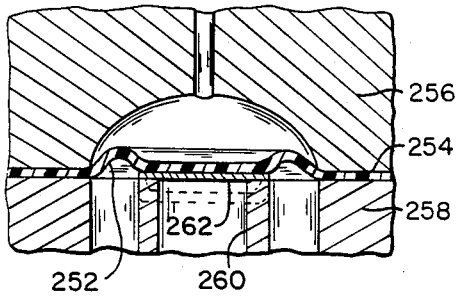
FIG. 9 is an illustration of preloading of a molded main diaphragm.

Additional force can be obtained for assisting the high control pressure by mechanically preloading the diaphragms. One means of preloading a diaphragm is to mold the free position of the diaphragm such that the diaphragm presses against the seat when installed. The diaphragm then naturally returns to a closed valve position to press against its valve seat when equal pressures are applied to the two faces of the diaphragm. This arrangement is illustrated in FIG. 9. A diaphragm 252 is molded into a gasket 254 which is clamped between upper and lower valve blocks 256 and 258. An annular valve seat is provided by the tube 260. In this case, a disc 262 is bonded to the diaphragm to prevent the diaphragm from being drawn into the tube 260, thus eliminating the need for a support grid. The free position of the diaphragm 252, carrying the plate 262, is shown in broken lines in FIG. 9. It can be seen that the tube 260 extends upward beyond the free position of the diaphragm. Therefore, as the disc 262 rests against the valve seat of tube 260, it is pressed firmly downward by the spring force of the diaphragm tending to return it to its free position.

Figure 10:
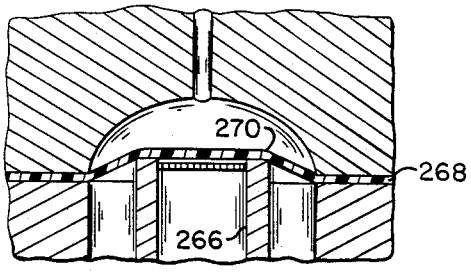
FIG. 10 is an illustration of a main diaphragm valve preloaded by a raised valve seat.

In the arrangement of FIG. 10, the annular valve seat on tube 266 is raised above the plane of the gasket 268, which is the free position plane of the diaphragm. The flat diaphragm 270 is thereby elastically deformed to cover the valve seat 266 and remains firmly seated against that valve seat. Of course, when the control pressure is low, the diaphragm is pushed even further above the plane of the gasket 268 by the higher pressure on the bottom side of the diaphragm to open the valve.

The mechanical preloading of the diaphragms and the ram pressure for the higher control pressures can be used together or separately to assure that the diaphragms close tightly against their valve seats.

While the invention has been particularly shown and described with reference to preferred embodiments thereof, it will be understood by those skilled in the art that various changes in form and details may be made therein without departing from the spirit and scope of the invention as defined by the appended claims. For example, any form of actuator could be used to control the pilot valve. Also pressure regulating switches reponsive to the load pressures may be interposed in the control ports to the supply valve control chambers. With such an arrangement, both the supply diaphragm and waste diaphragm might be held closed once sufficient supply fluid has passed through the supply valve to raise the load pressure to a predetermined level. An example of such a regulating switch can be found in my U.S. patent application Supply Control Valve With Integral Pressure Limiter, Ser. No. 602,420, filed Apr. 20, 1984.

I claim:

1. A pilot operated supply and waste control valve of the type comprising two main diaphragm valves communicating with each of at least one load port for alternately supplying and exhausting a supply fluid to and from each load port, the supply fluid have a supply pressure, and control means for controlling fluid pressure on control surfaces of the main diaphragms to open and close a supply diaphragm valve associated with each load port while conversely closing and opening a waste diaphragm valve associated with each load port, the control means comprising:

means for deriving a higher control fluid pressure from the supply pressure of the supply fluid;

a pilot valve for applying control fluid pressure on the control surface of one of the diaphragm valves communicating with each load port, the control fluid pressure being the higher control fluid pressure when the pilot valve is in a first position and being a lower pressure when the pilot valve is in a second position; and a pressure reversing valve for applying a reversed control pressure to the other diaphragm valve communicating with each load port, the pressure reversing valve comprising a supply and waste valve actuated by a pressure driven element, the control fluid pressure applied by the pilot valve being applied to a control surface of the pressure driven element and lower pressure being constantly applied to a surface on the pressure driven element opposite to the control surface.

2. A supply and waste control valve as claimed in claim 1 wherein the pressure driven element of the pressure reversing valve is a diaphragm.

3. A supply and waste control valve as claimed in claim 2 wherein the diaphragms of the main diaphragm valves and of the pressure reversing valve lie in a common plane.

4. A supply and waste control valve as claimed in claim 2 wherein the diaphragms of the main diaphragm valves and of the pressure reversing valve are formed on a common sheet of flexible material positioned between upper and lower sections of the valve to serve as a gasket.

5. A supply and waste control valve as claimed in claim 1 wherein the higher control pressure applied to the diaphragm valves by the control means is derived from a ram nozzle directed into the supply fluid to produce a control pressure higher than the supply pressure.

6. A supply and waste control valve as claimed in claim 1 wherein the pressure reversing valve comprises:

a reversed-pressure chamber having opposing valve seats at higher and lower pressure ports and a control pressure port for directing said reversed pressure to said other diaphragm valve communicating with each load port;

a valve member between the valve seats for alternately closing said higher and lower pressure ports;

the pressure driven element closing a control pressure chamber, the surface of the pressure driven element opposite to the control pressure chamber being exposed to lower pressure; and connecting means for connecting the pressure driven element to the valve member to close the higher pressure port as higher pressure is applied to the control pressure chamber and to close the lower pressure port as lower pressure is applied to the control pressure chamber.

7. A supply and waste control valve as claimed in claim 6 wherein the connecting means extends through the lower pressure port into the reversed-pressure chamber.

8. A supply and waste control valve as claimed in claim 7 wherein the pressure driven element is a diaphragm.

9. A supply and waste control valve as claimed in claim 8 wherein the diaphragms of the main diaphragm valves and of the pressure reversing valve are formed on a common sheet of flexible material positioned between upper and lower sections of the valve to serve as a gasket.

10. A supply and waste control valve as claimed in claim 6 wherein the connecting means is a pivotal arm.

11. A supply and waste control valve as claimed in claim 1 wherein the pilot valve comprises a rocker arm valve member extending from a controlled pressure chamber through a fluid seal.

12. A supply and waste control valve as claimed in claim 1 wherein:

each supply diaphragm valve comprises a valve seat on the supply fluid side of the diaphragm positioned beyond a free position of the diaphragm to mechanically preload the diaphragm against its seat.

13. A supply and waste control valve as claimed in claim 12 wherein each preloaded diaphragm is molded such that the valving surface of the diaphragm presses against the valve seat.

14. A pilot operated fluid supply and waste valve of the type comprising two main diaphragm valves communicating with a load port for alternately supplying and exhausting supply fluid to and from said load port, the supply fluid having a supply pressure, and control means for controlling fluid pressure on the control faces of main valving diaphragms incorporated in said main diaphragm valves to open and close a supply diaphragm valve communicating with said load port while conversely closing and opening a waste diaphragm valve communicating with said load port, the control means comprising:

a pilot valve providing an output pilot control pressure having a value derived from and about equal to the supply pressure of said supply fluid when the pilot valve is in a first position and a lower pressure value when the pilot valve is in a second position, wherein said pilot control pressure is applied on the control face of one of the main valving diaphragms and said pilot control pressure is also applied to one side of a pressure driven element having lower pressure constantly applied to a second side of said pressure driven element opposite the first side, wherein said pressure driven element actuates a supply and waste type pressure reversing valve to apply reversed pressure to the control face of the other main valving diaphragm.

15. A pilot operated fluid supply and waste valve of the type comprising four main diaphragm valves communicating with two separate load ports for alternately supplying and exhausting supply fluid to and from each load port, the supply fluid having a supply pressure, and control means for controlling fluid pressure on the control face of the diaphragms incorporated in said main diaphragm valves to open and close a supply diaphragm valve communicating with each load port while conversely closing and opening a waste diaphragm valve communicating with each load port, the control means comprising:

a pilot valve providing an output pilot control pressure having a value derived from and about equal to the supply pressure of said supply fluid when the pilot valve is in a first position and a lower pressure value when the pilot valve is in a second position, wherein said pilot control pressure is applied to said control face of said main supply diaphragm valve communicating with one load port and to the control face of said main waste diaphragm valve communicating with the other load port, and said pilot control pressure is also applied to one side of a pressure driven element having lower pressure constantly applied to a second side of said pressure driven element opposite to the first side, wherein said pressure driven element actuates a supply and waste type pressure reversing valve to apply reversed pressure to the control faces of the two remaining main diaphragm valves.

* * * * *